United States Patent [19]

Egger

[11] 3,947,249

[45] Mar. 30, 1976

[54] STERILIZING DEVICE FOR WEB SHAPED PACKAGING MATERIAL

[75] Inventor: Hermann Egger, Fribourg, Switzerland

[73] Assignee: Quepor S.A., Fribourg, Switzerland

[22] Filed: Apr. 15, 1974

[21] Appl. No.: 461,237

[30] Foreign Application Priority Data

Apr. 20, 1973 Italy ..... 49592/73

[52] U.S. Cl. ..... 21/92; 21/58; 21/93; 21/99; 53/167

[51] Int. Cl.². A61L 3/00; A61L 13/04; B65B 55/10

[58] Field of Search ..... 21/91–93, 99, 21/58; 53/167; 134/15, 64, 122

[56] References Cited

UNITED STATES PATENTS

| | | | |
|---|---|---|---|
| 2,549,059 | 3/1951 | Cloud | 53/167 X |
| 2,917,883 | 12/1959 | Rock | 53/167 X |
| 3,383,831 | 5/1968 | Goldsmith et al. | 21/92 X |
| 3,466,841 | 9/1969 | Rausing | 21/91 X |
| 3,466,850 | 9/1969 | Hudson et al. | 21/92 UX |
| 3,513,627 | 5/1970 | Doucette et al. | 21/91 UX |
| 3,530,641 | 9/1970 | Bergstrom | 53/167 |
| 3,692,468 | 9/1972 | Loliger et al. | 21/91 X |
| 3,750,367 | 8/1973 | Barker et al. | 21/58 X |
| 3,854,874 | 12/1974 | Loliger et al. | 21/93 X |

FOREIGN PATENTS OR APPLICATIONS

| | | | |
|---|---|---|---|
| 68,099 | 6/1951 | Netherlands | 21/91 |

*Primary Examiner*—Joseph Scovronek
*Assistant Examiner*—Bradley R. Garris
*Attorney, Agent, or Firm*—Browdy and Neimark

[57] ABSTRACT

A sterilizing device for web shaped packaging material in which the length of travel of the web after sterilant has been applied is increased, prior to the drying operation, and the sterilant on the film is heated during this increased path in order to increase the activity of the sterilant and allow complete sterilization even at high speeds. This is accomplished by a heated metal cylinder and a chamber which surrounds the web between the cylinder and the drying operation, into which chamber is blown heated sterile air.

6 Claims, 3 Drawing Figures

STERILIZING DEVICE FOR WEB SHAPED PACKAGING MATERIAL

A major problem in food packaging industry is the efficient sterilization of the food containers, which must occur before the food is introduced into them.

In the type of packaging machines which form the containers from a web of packaging material, the latter is generally sterilized by being fed into a sterilizing apparatus located upstream of the packaging machine, while the latter must be built in such a manner that the web is prevented from any contact with the unsterile ambient air during the various stages of its processing, until it is converted into a filled and completely sealed package.

One of the requirements for an efficient sterilization of the web is a sufficiently protracted exposure of its surfaces to the sterilant while it passes through the sterilizing device, since no suitable sterilant is capable of instantly destroying microorganisms. This requirement directly contrasts with the necessarily high speeds at which the packaging material webs are forced to pass through the sterilizing device owing to the great production rate of today's packaging machines.

In order to shorten this exposure, it has already been suggested to heat the sterilant in the tank containing it, since its activity increases with the temperature. However, this temperature cannot be raised beyond the limit determined by the heat resistance of the plastic material coating or entirely constituting the web on one hand, and by the collateral effect that heat accelerates the decomposition of the sterilant used, generally hydrogen peroxide, on the other hand.

It is the object of the present invention to supply a sterilizing device, which permits the very efficient sterilization at webs passing at great velocities through it without accelerating the decomposition of said sterilant.

According to the present invention, this goal is attained by a sterilizing device of the type having sterilant applying means and a drying chamber, which device comprises means to lengthen the path of said web between said sterilant applying means and said drying chamber, and means to heat said sterilant film and keep it hot during part of this path.

In this device, a protracted contact between the web surface and a hot sterilant film is obtained even at high web speeds, and, additionally, the heat to increase the action of the sterilant is not applied to the tank, where it would lead to an accelerated decomposition of all the sterilant contained in it, but merely to the sterilant film adhering to the web surface after its application, in other words to the sterilant which must at any rate be evaporated from the web before the latter enters the packaging machine, in order to prevent the sterilant from contaminating the food with which the finished containers will be filled.

For a purely illustrative and in no way limitative purpose, three embodiments of the present invention will now be described with reference to the attached drawings, wherein he components, which in all three embodiments are similar or have similar functions, carry identical reference signs.

Figure 3:
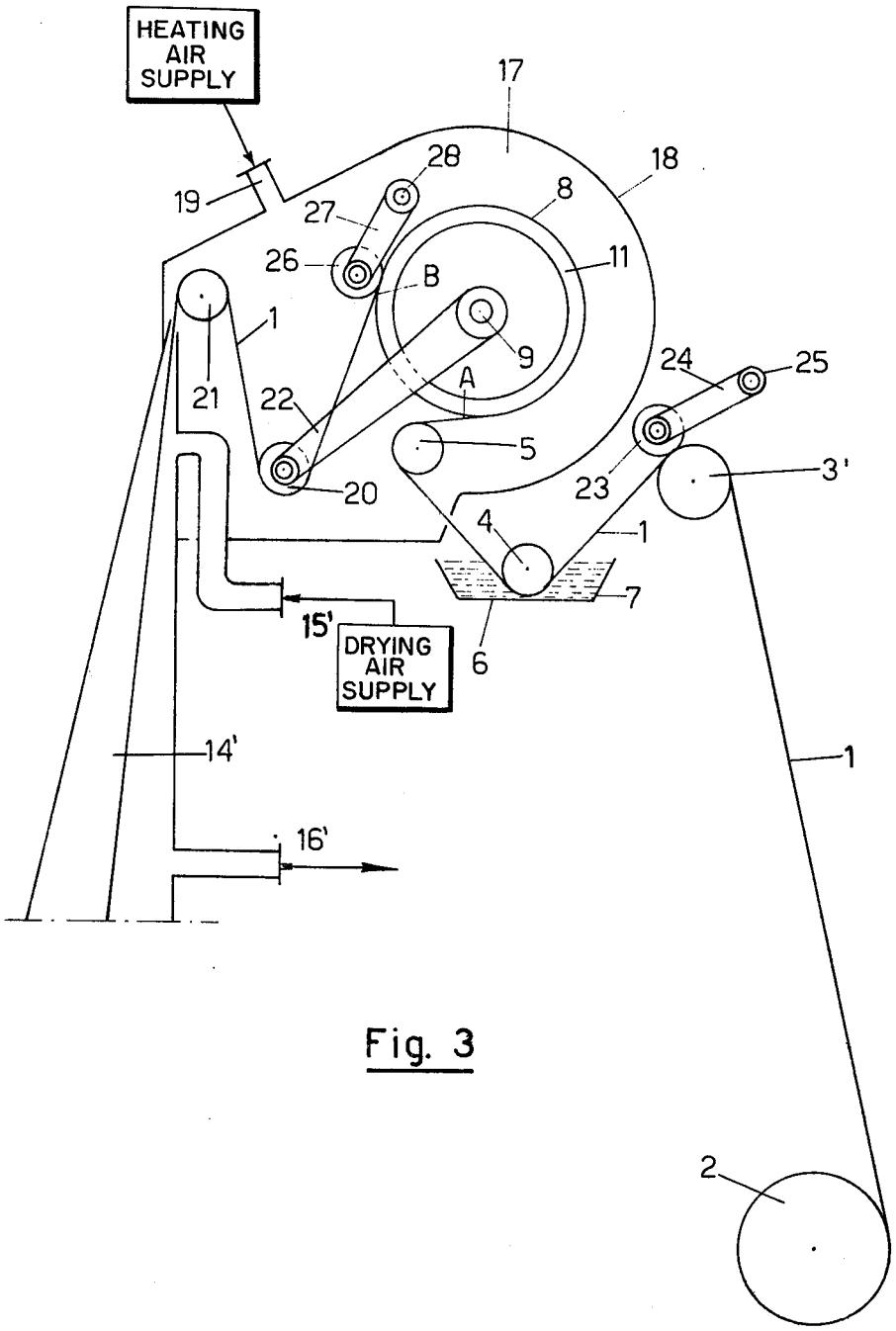

FIG. 3 a similar view of the third embodiment.

Figure 1:
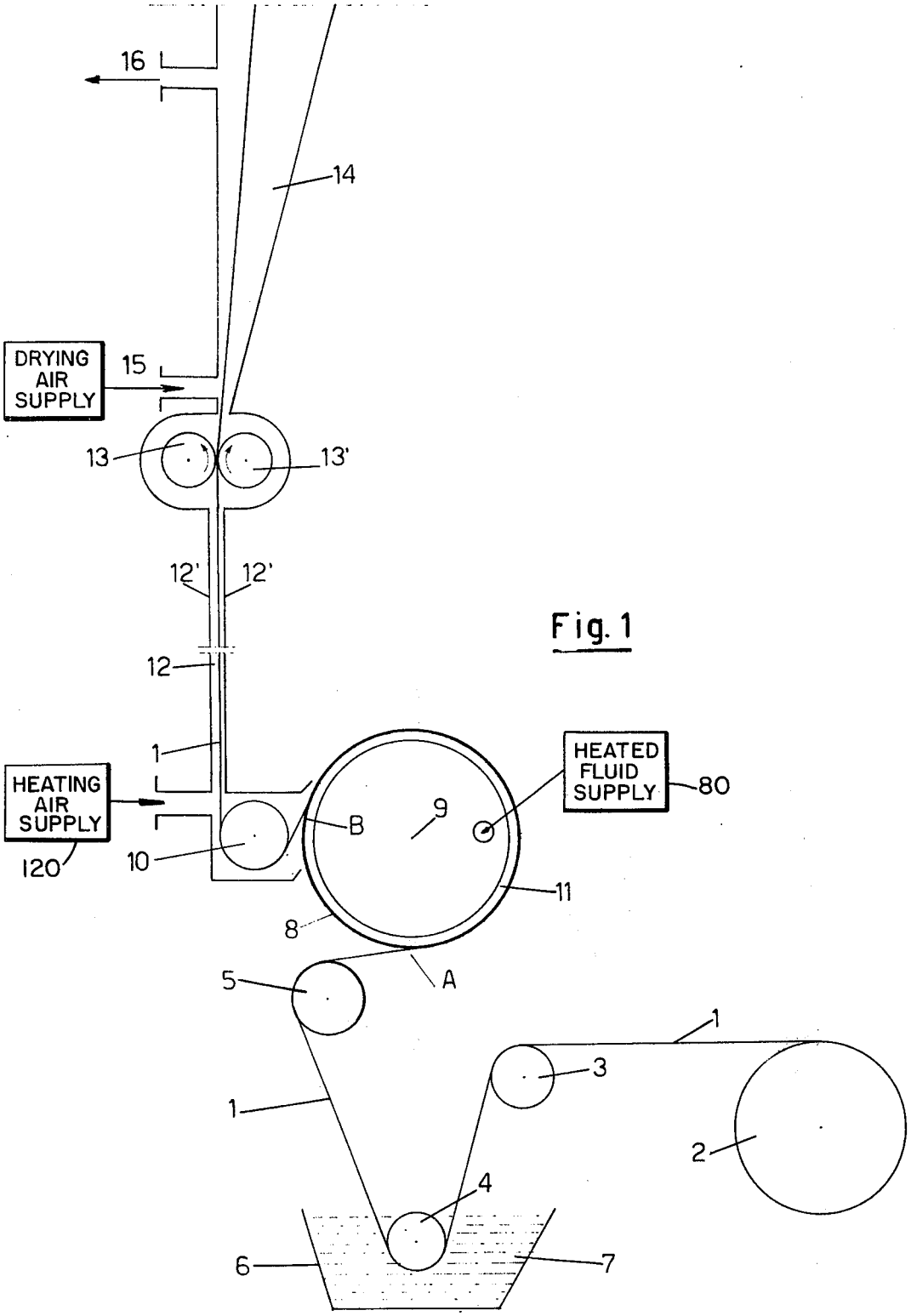
FIG. 1 is a schematic elevational view of the first embodiment.

In the embodiment of FIG. 1, the web of packaging material 1 is conveyed from a reel 2 over a first guide roll 3, thence under a deflecting roll 4 dipping in a cold sterilant 7 contained in a tank 6. The sterilant used is preferably a hydrogen peroxide solution.

From said tank 6 the web issues with a film of cold sterilant adhering to its surfaces, and is deflected by a roll 5 upon the surface of a heated metal cylinder 8, which is freely rotatable around its shaft 9. The cylinder 8 may be heated by means of a fluid circulating under its surface, as shown schematically by the heated fluid supply 80 in FIG. 1. The web 1 is kept wound around the greater circumferential part of the cylinder surface by a second deflecting roll 10. The arc of contact between the cylinder surface and the web extends between the generatrix A, where the web reaches the cylinder surface to B, where it leaves said surface, to pass under said second deflecting roll 10 and thence between two squeeze rolls 13 and 13', one of which is preferably a drive roll imparting the motion to the web 1, to pass finally into a drying chamber 14 prior to entering the packaging machine. A chamber 12, into which hot sterile air is blown under pressure by hot air supply means 120 encloses the web between the location where it leaves the cylinder 8 up to its entrance into the drying chamber 14. This chamber is delimited by a casing 12', which surrounds the deflecting roll 10, the two squeeze rolls 13 and 13' and the web portion running from point B to said squeeze rolls. Its lower rim hugs as near as possible the cylinder surface above and below said point B, while above the squeeze rolls 13 and 13' it is provided with a narrow slit forming the passageway for the web 1 into the drying chamber. The hot sterile air blown into said chamber 12 has a double task. One is that of preventing the inflow of unsterile outer air into the chamber 12 through the slit defined between the lower rim of casing 12 and through the upper slot forming said passage way; the other purpose is that of maintaining the high temperature and thus the increased activity of the sterilant film up to its introduction into the drying chamber. In the latter, the sterilant film is completely evaporated by a flow of dry sterile air entering the drying chamber through a pipe 15 and issuing therefrom through a pipe 16.

Obviously, the length of the path in which the web travels in contact with the sterilant applied to it may be varied by varying the diameter of cylinder 8 or the extension of the chamber 12 or by changing the number and mutual distance between guide rolls, or by varying all these factors. It is also obvious that higher web speeds require longer sterilization paths.

As stated, the feed motion is imparted to the web of packaging material 1 by at least one of the rolls 13, 13', and the cylinder 8, which is freely rotatable around its shaft 9, is entrained in rotation by the web, so that there exists practically no relative movement between cylinder surface and web.

Figure 2:
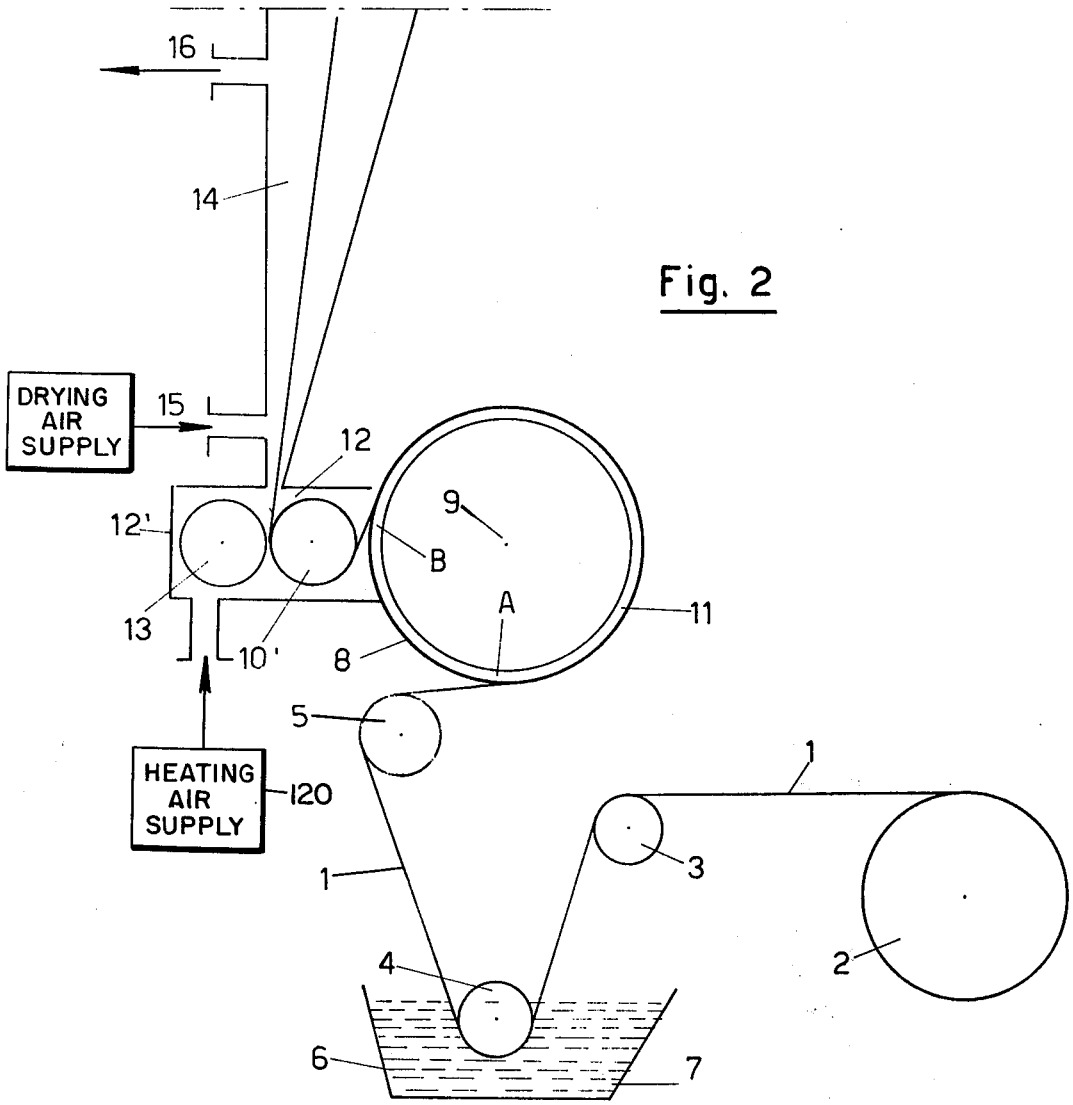
FIG. 2 is a similar view of the second embodiment.

The embodiment shown in FIG. 2 differs from that of FIG. 1 merely in that the hot air chamber 12 defined by the casing 12' is much shorter and the deflecting roll 10' also acts, together with the counter roll 13, as a combination squeeze roll and drive roll for the web 1.

The third embodiment, illustrated in FIG. 3, is an overhead sterilizing device, which is intended for packaging machines where the web infeed movement is not continuous, but intermittent.

In this embodiment, the web is driven in a continuous movement by the first guide roll 3', against which it is pressed by a pressure roller 23 rotatably mounted on the free end of an oscillating lever 24 pivotable around a stationary pivot 25.

After emerging from the sterilant tank 7, the web passes through a narrow slot into the hot air chamber 17 delimited by a casing 18. Hot sterile air at an overpressure is blown into said chamber through a pipe 19, to prevent the inflow of unsterile ambient air into the chamber 17 through the interstices and the slot existing in it.

The chamber 17 encloses the metal cylinder 8 and the two deflecting rolls 5 and 20, which keep the web wound around the major part of the heated circumferential surface of cylinder 8. Also in this figure this part is indicated by the letters A and B, the first showing the generatrix at which the web contacts the cylinder surface and B the generatrix along which the web leaves this surface. In order to take up the slack forming in the web during the intermittences of its infeed motion into the packaging machine, the second deflecting roll consists of a dancer or dandy roll 20, whose shaft is mounted on one end of a lever 22, which is pivotable around the shaft 9 of cylinder 8. As a further measure to prevent the web from being lifted away from the cylinder surface during said intermittences, an additional pressure roll 26, attached to a lever 27, which is pivotable around a pivot 28, presses said web 1 against the cylinder 8 approximately at the point B, at which said web leaves the cylinder surface.

From roll 20, the web 1 passes over a third deflecting roll 21 and thence, through a slot in casing 18, into the drying chamber 14', where the residual sterilant is evaporated from said web surface by a flow of dry sterile air entering through pipe 15' and issuing through pipe 16'.

It is obvious that many changes and variations may be applied to the above described embodiments. Thus, the length of the path covered by the web between its emersion from the sterilant tank and its entrance into the drying chamber, or between its contact with the heated metal surface of the cylinder or cylinders and said entrance into the drying chamber may be varied by changing the cylinder diameter, the number of the heating cylinders or the number and mutual distance of the guide and deflecting rolls between said two points. Obviously, care must be taken that the amount of sterilant applied to the web is sufficiently large, so that it has not completely evaporated and therefore may still exert its action on the web surface before said web enters the drying chamber.

What is claimed is:

1. In a sterilizing device for web shaped packaging material comprising applying means for applying a sterilant film to a web and a drying chamber means for evaporating sterilant from the web, the improvement wherein said device further comprises:

path lengthening means interposed between the applying means and the drying chamber means for increasing the length of the path of travel of the web therebetween; and heating means for heating said sterilant film along at least a part of said path of travel between the applying means and the drying chamber means, without substantially evaporating the sterilant film, wherein said path lengthening means include a cylinder interposed in said path and contacting the web, and deflecting means for directing the web into contact with said cylinder along a part of the circumference thereof and wherein said heating means include means for heating said cylinder to a temperature sufficient to increase the sterilization activity of the sterilant film on the web without causing substantial evaporation thereof, an enclosure means for enclosing the web for at least a portion of the path of travel between the applying means and the drying chamber means, said enclosure means at least partially surrounding the circumference of said cylinder and extending substantially to the entrance of the web into the drying chamber means, said enclosure means substantially completely enclosing the web therein and having a narrow slit at the end thereof at which the web exits to the drying chamber means, thereby substantially thermally isolating the drying chamber means from said enclosure means; and enclosure heating means for heating the sterilant film of the web within said enclosure means without causing substantial evaporation thereof.

2. A device in accordance with claim 1, wherein said deflecting means is further for causing the web to come into contact with a major portion of the circumference of said cylinder.

3. A device in accordance with claim 1, wherein said means for heating said cylinder comprises means for circulating heated fluid beneath the surface of said cylinder.

4. A device in accordance with claim 1, wherein said heating means further comprises means to blow hot sterile air into said enclosure means.

5. A device in accordance with claim 1, wherein said enclosure means encloses only the portion of the circumference of said cylinder at which the web leaves said cylinder.

6. A device in accordance with claim 1, wherein said enclosure means encloses the entirety of said cylinder and extends from a position on the path of travel of the web between said applying means and said cylinder substantially to the entrance of the web into the drying chamber means.

* * * * *

UNITED STATES PATENT AND TRADEMARK OFFICE

Certificate

Patent No. 3,947,249 Patented March 30, 1976

Hermann Egger

Application having been made by Hermann Egger, the inventor named in the patent above identified, and International Paper Co., the assignee, for the issuance of a certificate under the provisions of Title 35, Section 256, of the United States Code, deleting the name of Hermann Egger and adding the name of Silvano Moscatelli as sole inventor, and a showing and proof of facts satisfying the requirements of the said section having been submitted, it is this 19th day of Mar., 1985, certified that the name of the said Hermann Egger is hereby deleted from the said patent as sole inventor and the name of the said Silvano Moscatelli is hereby added to the said patent as sole inventor.

Fred W. Sherling,
*Associate Solicitor.*